US006319139B1

(12) United States Patent
Tracy

(10) Patent No.: US 6,319,139 B1
(45) Date of Patent: Nov. 20, 2001

(54) WATER PARK PLAY APPARATUS

(76) Inventor: Wyeth G. Tracy, 591 Albright Road, Uxbridge Ontario (CA), L9P 1R4

( * ) Notice: Subject to any disclaimer, the term of this patent is extended or adjusted under 35 U.S.C. 154(b) by 0 days.

(21) Appl. No.: 09/680,411

(22) Filed: Oct. 6, 2000

(51) Int. Cl.[7] ..... A63G 31/00
(52) U.S. Cl. ..... 472/128; 472/117
(58) Field of Search ..... 472/13, 117, 128, 472/136, 137; 482/35

(56) References Cited

U.S. PATENT DOCUMENTS 4,573,679 * 3/1986 Janszen ..... 472/128
5,299,588 * 4/1994 MacLeod ..... 135/16
5,480,336 * 1/1996 Blanchard ..... 446/89
5,649,867 * 7/1997 Briggs ..... 472/128
5,741,189 * 4/1998 Briggs ..... 472/128

* cited by examiner

*Primary Examiner*—Kien T. Nguyen
(74) *Attorney, Agent, or Firm*—Riches, McKenzie & Herbert

(57) ABSTRACT

An amusement device for installation in a water park provides a spray or stream of water used to cool play participants. The device includes an elongated generally tubular member secured in a generally upright orientation and a water nozzle positioned towards the uppermost end of the tubular member. The elongated tubular member is characterized by a generally rigid lower portion and a semi-rigid upper portion having a rigidity selected so that the application of a rotational, lateral or vibrational force on the member by a play participant results in the deflection or reciprocal movement of the outlet nozzle so as to alter the pattern of water spray emitted from the nozzle.

20 Claims, 3 Drawing Sheets

FIG. 1.
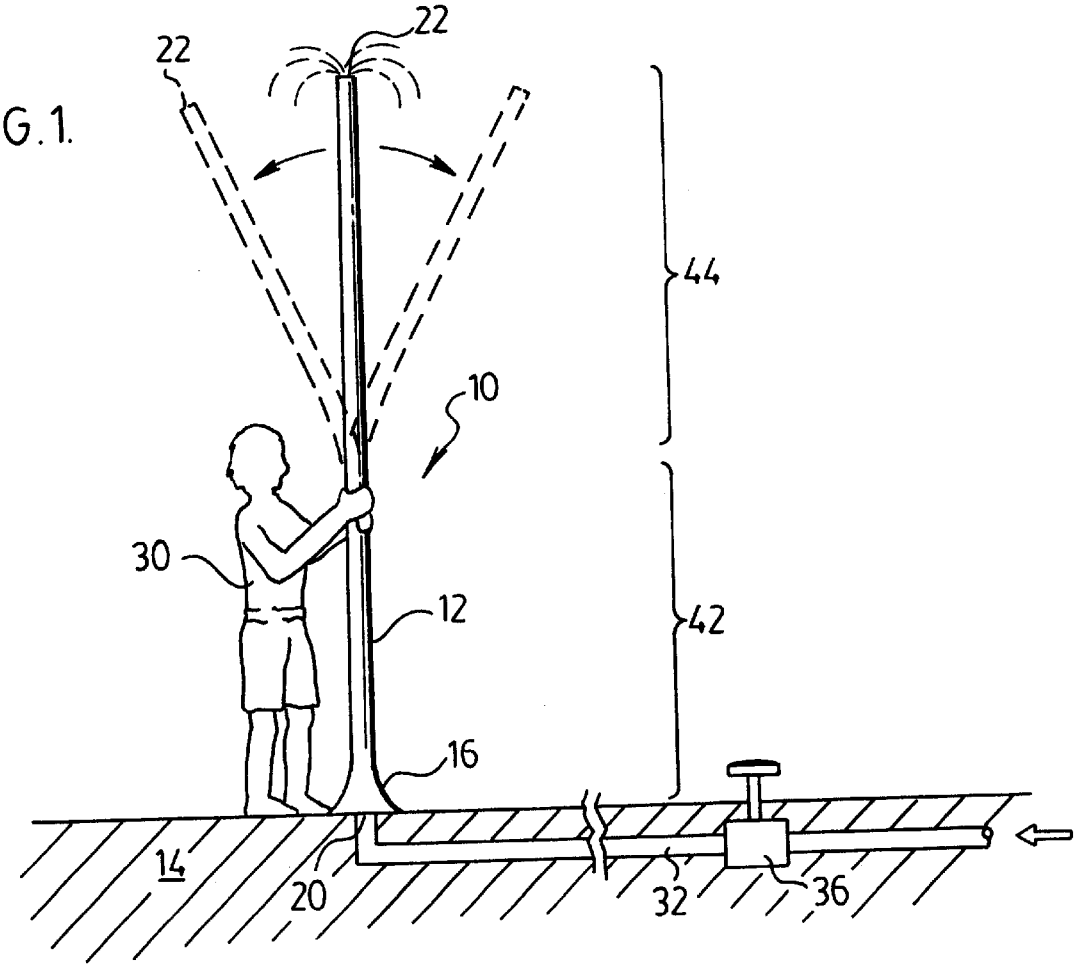
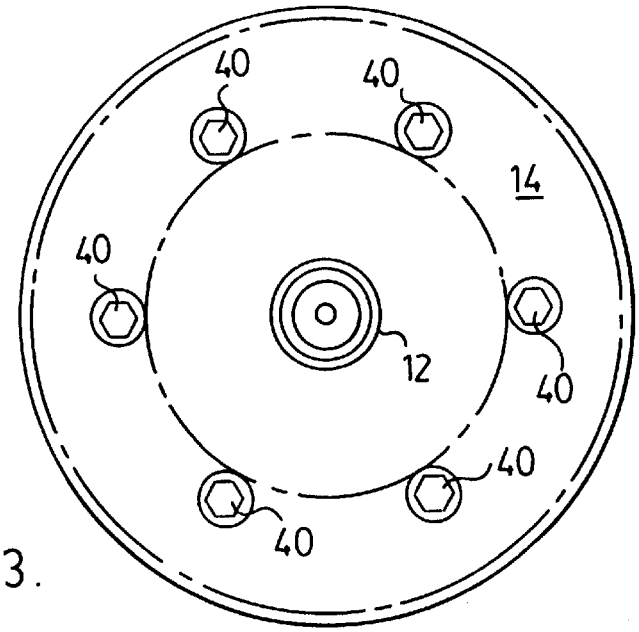
FIG. 3.

WATER PARK PLAY APPARATUS

SCOPE OF THE INVENTION

The present invention relates to a play apparatus for erection in a water, spray or theme park environment and more particularly, a water play apparatus which may be user activated to vary the pattern and intensity of a cooling water spray on play participants.

BACKGROUND OF THE INVENTION

Water based play structures used in water parks are well known. Conventional water play structures, such as for example is disclosed in U.S. Pat. No. 5,378,197 to Briggs, issued Jan. 3, 1995, typically consists of multi-level structures which have slides and/or user operated water cannons mounted at various heights thereon.

While conventional water play apparatus are designed to permit interactive participation by a user, as for example, by having user activated valves or the like, the size and complexity of manufacture makes their manufacture prohibitively expensive for all but the largest theme parks.

Further, conventional water play apparatus suffer the disadvantage in that they are both expensive to maintain and repair should, for example, damage occur to the play structure.

SUMMARY OF THE INVENTION

The present invention overcomes at least some of the disadvantages of prior art devices by providing a water play amusement device which includes an elongated and generally vertically extending water spray tube. The tube is characterized by an upper portion formed having a semi-rigid wall construction so as to permit its deflection when the tube is vibrated or shaken by a user, and one or more water spray nozzles disposed towards an upper end of the tube, from which a participant cooling water spray is emitted.

Another object of the invention is to provide a user actuated water spray device which permits participatory play by the user, and which may be inexpensively manufactured and easily maintained.

Another object of the invention is to provide an amusement device adapted to provide a cooling water spray to play participants and which may be actuated in movement by a user to alter the direction or pattern of water flow and/or water spray.

Another object of the invention is to provide a water play apparatus for installation at a water park, theme park, spray park or amusement park and which permits simplified installation and/or repair.

A participant activated amusement device is adapted for installation in a water park, spray park, amusement park, or theme park, hereinafter collectively referred to as a water park. The device provides one or more sprays or streams of water used to cool users or play participants. The device includes an elongated member which preferably has a generally tubular construction, and which is secured in a generally upright orientation. One or more water nozzles or outlets are positioned towards the uppermost end of the tubular member from which the cooling water spray is emitted. The elongated tubular member is characterized by a generally rigid lower portion and a semi-rigid upper portion. The rigidity of the upper portion is selected so that the application of a rotational, lateral and/or vibrational force on the tubular member by a play participant or user, results in the deflection or vibratory movement of the nozzle or outlet, so as to alter the water spray pattern emitted from the device.

The tubular member may, for example, consist of a hollow member which is coupled to a base for securement to the ground or an underlying support surface such as a deck, swimming pool bottom or the like. Water flow travels beneath the support surface or ground via a supply conduit, and then either along the tubular member or through a centrally extending bore formed therein to the nozzle or water outlets.

In a preferred construction, the tubular member consists of a hollow tube having a length selected at between about 6 and 30 feet, and more preferably between about 12 and 23 feet, however, longer or shorter tubes could also be used. In one simplified construction, the tube is formed with a tapering or sidewall construction which as a result of its thinning construction forms the semi-rigid portion. While the tube may be formed from various metals, plastics and/or composites, a tube consisting of filament fiberglass which is wound in a longitudinal orientation extending generally in the direction of the elongated axis of the tube has been found to be highly preferred.

Preferably, the rigidity of the tube is selected to prevent the downward deflection or bending of the uppermost tip of the tube below a height where it might otherwise strike a play participant. In a preferred embodiment, a tube having an axial length of approximately 18 to 22 feet is provided. The tube has a minimum rigidity selected so that when the tube is mounted in a vertical orientation and vibrated by the application of a maximum lateral force, the upper endmost tip of the tube will deflect or bend downwardly to a height which is a minimum of at least 8 feet above the support surface. More preferably, the rigidity of the tube is selected so as to limit deflection of the uppermost end to an orientation where the end tip is at a position oriented approximately 90° from the axis of the tube when at rest.

In a more preferred embodiment, a user activated valve may be provided which is selectively operable to initiate and/or stop water flow from all or individual water nozzles.

Accordingly, in one aspect, the present invention resides in a user actuated water park amusement device comprising, an elongated tubular member defining an axially extending bore and having an inlet end, an outlet end, and a water nozzle being spaced proximate said outlet end, a base for securing said tubular member in a generally upright orientation with said outlet end spaced vertically above said inlet end, a water supply conduit for providing water flow vertically along said bore and outwardly from said nozzle, said tube being characterized by a generally rigid lower portion and a semi rigid upper portion, the upper portion having a rigidity selected whereby in a relaxed state the tubular member maintaining said generally upright orientation aligned with said axis, and wherein the application of rotational or vibrational forces on said tube by the user produces deflection of the upper portion of the tubular member relative to the axis, without significant deflection of the lower end.

In another aspect, the present invention resides in a user actuated water amusement device comprising, an elongated hollow tubular member having a radially extending sidewall defining a hollow axially extending bore, in an unbiased position the tube extending generally vertically along said axis from a lower inlet end to an upper outlet end, a water supply conduit for providing water flow vertically along said bore and outwardly from said outlet end, said sidewall including a lower portion having a first minimum radial thickness and an upper portion having a second radial thickness selected less than the first thickness, the first and second thicknesses selected to permit deflection of the upper outlet end to a biased position moved away from the axis upon the application of a manual rotational or vibrational force by said user, without significant deflection of the lower portion.

In a further aspect, the present invention resides in a user actuated water amusement device comprising, a tubular member elongated along a longitudinally extending axis, and defining an axially extending bore, said tubular member having a lower inlet end, an outlet end, and a water nozzle being spaced proximate said outlet end said tubular member secured in a generally vertical orientation with said outlet end spaced vertically above said inlet end, a water supply conduit for providing water flow vertically along said member and outwardly from said nozzle, said tube being characterized by a generally rigid lower portion having a length selected greater than a height of said user and a semi rigid upper portion spaced above said lower portion, the upper portion having a rigidity selected whereby the application of lateral, rotational or vibrational forces on said tube produce a maximum downward deflection of the outlet end to a position spaced vertically above the lower portion.

BRIEF DESCRIPTION OF THE DRAWINGS

Reference is now had to the following detailed description taken together with the accompanying drawings in which:

FIG. 1 shows schematically a water park amusement device in use in accordance with a preferred embodiment of the invention;

FIG. 3 shows a top view of the base structure used in mounting the device of FIG. 1;

DETAILED DESCRIPTION OF THE DRAWINGS

Reference is first made to FIG. 1 which illustrates a user interactive water play device 10 for use in a water park in accordance with a preferred embodiment of the invention. The device includes a water spray tube 12 which is elongated along a direction of axis $A–A_1$ which, as will be described, is mounted in a generally vertical orientation to a concrete pad 14 by means of abase 16.

Figure 2:
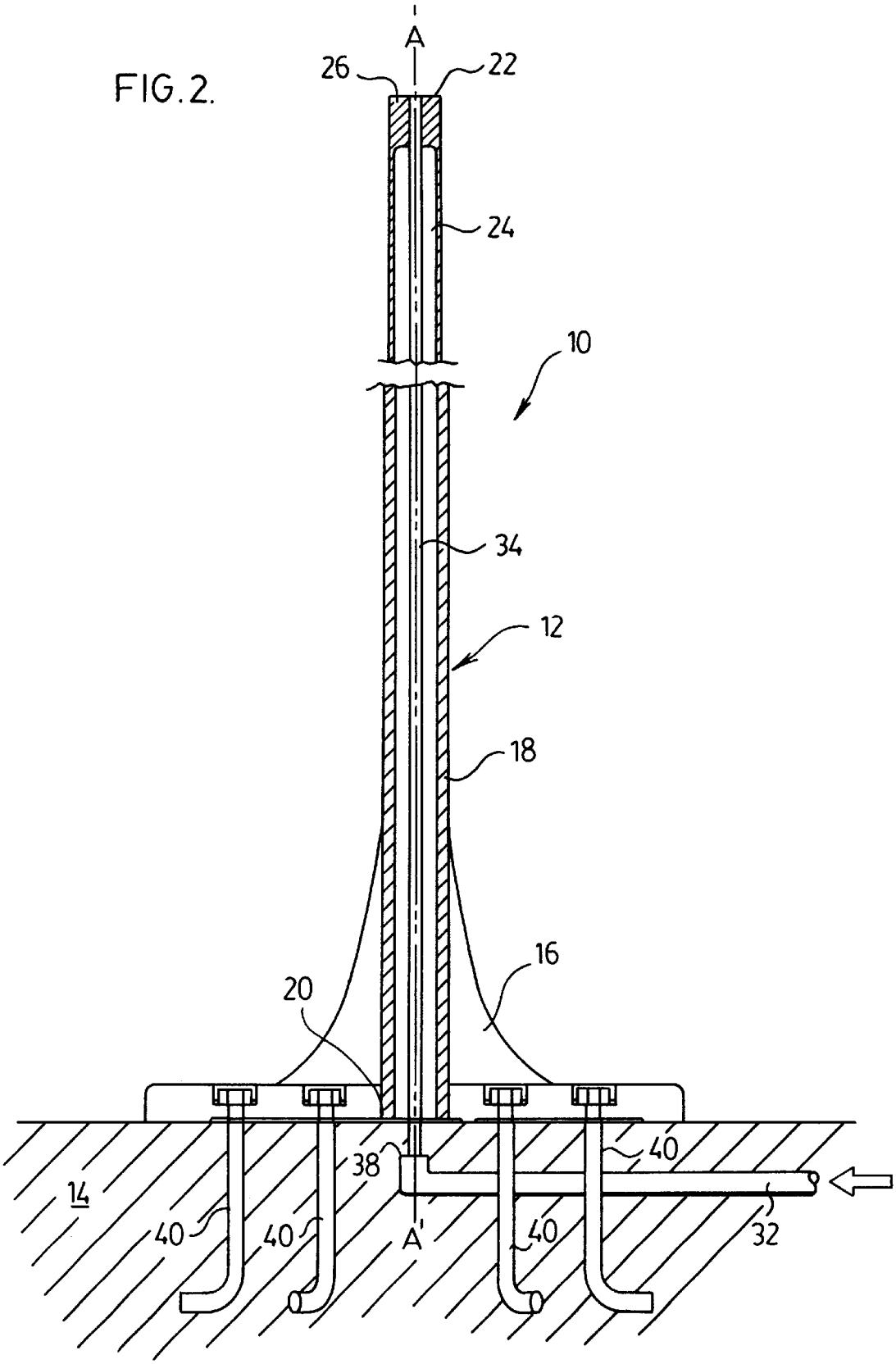
FIG. 2 illustrates an enlarged cross-sectional view of the water park amusement device of FIG. 1 at rest in an unbiased position.

FIG. 2 shows best the tube 12 as having a radially extending sidewall 18 which extends about the axis $A–A_1$ to define an axially extending hollow bore 24. The sidewall 18 tapers inwardly in radial thickness from a lowermost bottom end 20 to an upper end 22. Where designed for water park applications, tube 12 has an overall length selected at between about 16 and 24 feet, and more preferably about 20 feet. In a preferred construction, the outer diameter of the tube at the bottom end 22 is selected at between about 2 and 4 inches, and more preferably about 3 inches. The thickness of the sidewall 18 at the bottom end 20 in the radial dimension is most preferably between 0.25 and 1 inch depending upon the material used in the manufacture of the tube 12. FIG. 2 shows best the sidewall 18 as tapering in thickness inwardly towards the upper end 22, with the bore 24 having a substantially constant cross-sectional diameter. The radial thickness of the sidewall 18 adjacent the upper end 22 preferably reduces to a range of between about 0.10 and 0.25 inches in thickness.

A laminar flow nozzle 26 is positioned at the upper end 22 of the tube 12 to provide a cooling water spray downwardly onto a play participant 30 (FIG. 1). FIGS. 1 and 2 show best the nozzle 26 as being provided in fluid communication with a buried water supply line 32 by means of a flexible conduit tube 34 (FIG. 2) which extends the vertical length of the bore 24. Water flow is regulated by a remote valve 36 (FIG. 1) which is opened or closed to permit or prevent a pressurized water flow outwardly through the nozzle 26.

For strength, the sidewall 18 is more preferably formed from filament strands of polyester and resin such as fiberglass or other plastic composites. The strands are wound generally in the longitudinal direction of the axis $A–A_1$ to allow flexure of the tube 12 at its uppermost end 22.

The thickness of the sidewall 18 is selected so that when a lateral force is applied to the tube 12, a lower portion 42 of the tube 12 which extends approximately the height of the user 12 does not deflect more than 12 inches, and more preferably, not more than 6 inches, from the vertical axis $A–A_1$. As a result of the decreasing sidewall thickness, an upper portion 44 of the tube 12 which is spaced vertically above the lower portion 42 is generally semi-rigid, so as to permit its bending movement or deflection of the end 22 away from the axis $A–A_1$ when the lateral force is applied. The rigidity of the upper portion 44 is selected so that the upper end 22 deflects laterally away from the axis $A–A_1$ and its rest position a maximum downward distance spaced above where the end 22 may otherwise contact any play participants 30 standing in the proximity of the device 10. Preferably, the rigidity of the upper portion 44 is selected so as to limit the maximum downward flexure of the end 22 to a height spaced vertically above the lower portion 42. More preferably, the rigidity of the upper portion 44 of the sidewall 18 is selected so that the application of rotational or vibrational forces by the user 30 produces a maximum deflection of the upper end 22 to an orientation of approximately 90° from the vertical axis $A–A_1$.

FIGS. 2 and 3 show best the base 16 used to secure the tube 12 in its vertical orientation. Where a concrete support surface 14 is provided, the base 16 is secured in place over an outlet end 38 of the supply line 32 by means of a series of J-anchor bolts 40. It is to be appreciated, however, that where the device 10 is to be used on different supporting surfaces, such as wooden decks or the like, suitable anchoring fasteners will be used.

FIG. 1 shows best the operation of the device 10 by a play participant 30. With the valve 36 open, and the tube 12 in an unbiased or rest position, the sidewall 18 has a sufficient rigidity such that the tube 12 assumes a generally vertical orientation with the nozzle 26 providing a cooling water stream onto any play participants 30 therebelow. By the user 30 manually applying a lateral force on the tube 12, as for example, by vibrating the tube or rotating the tube 12 about the vertical axis $A–A_1$ with his or her hands, the upper end 22 of the tube 12 is reciprocally deflected away from the axis $A–A_1$ to the positions shown in phantom in FIG. 1. Further, the increasing thickness of the sidewall 18 towards the bottom end 20 results in the maximum deflection of the upper portion of the tube 12 adjacent the upper end 22, while the lower portion of the tube 12 adjacent the bottom edge 20 and user 30 does not significantly deflect and remains generally rigid.

Figure 4:
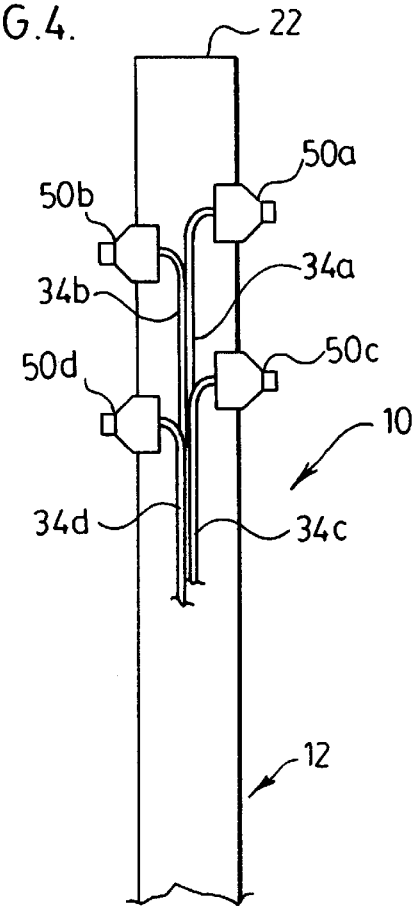
FIG. 4 illustrates schematically a cross-sectional view of a water outlet nozzle construction used in the apparatus of FIG. 1 in accordance with another embodiment of the invention.

Although FIG. 1 describes and illustrates the device 10 as having a single laminar flow nozzle 26, the invention is not so limited. If desired, the tube 12 could be provided with two, three or more outlet nozzles without departing from the spirit and scope of the invention. Reference is made to FIG. 4 which shows the upper end 22 of the tube 12 in accordance with a further embodiment of the invention wherein like reference numerals are used to identify like components. In FIG. 4, in place of the outlet nozzle 26, the tube 12 is provided with four lateral spray nozzles 50*a*,50*b*,50*c*,50*d*. Each of the spray nozzles 50*a*,50*b*,50*c*,50*d* are provided in fluid communication with the water supply line (not shown) by a corresponding conduit tube 34*a*,34*b*,34*c*,34*d*.

Figure 5:
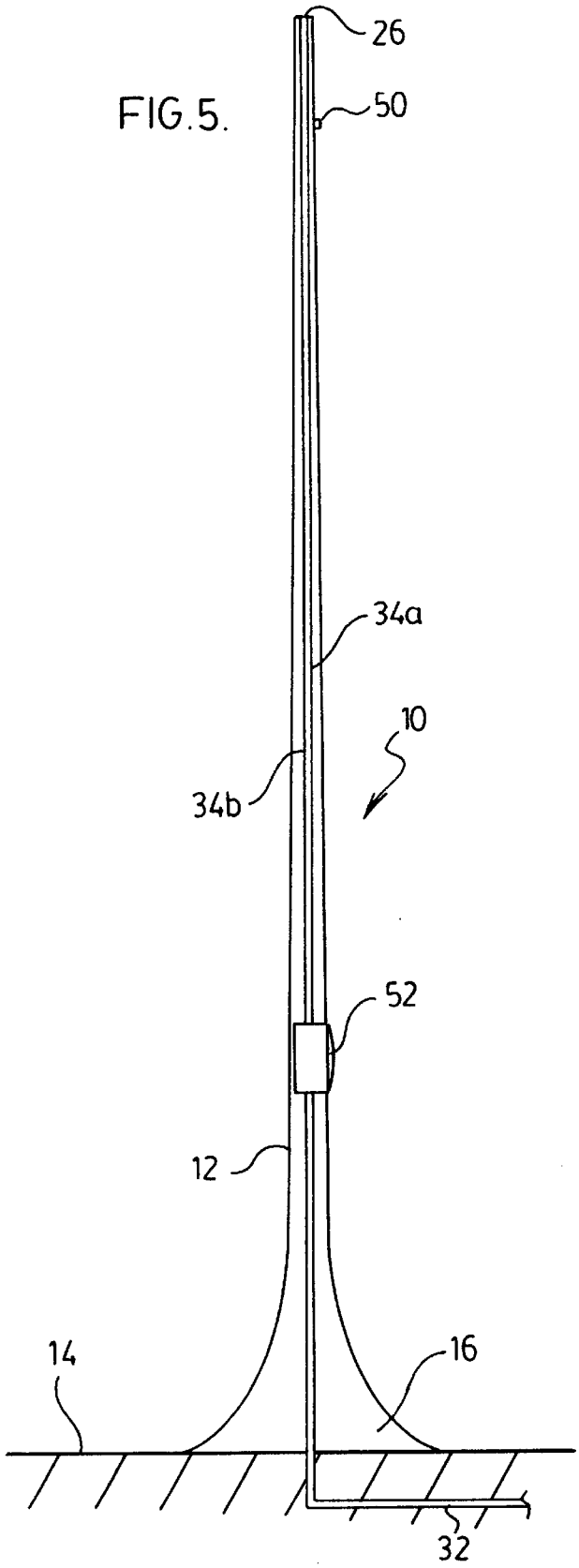
FIG. 5 illustrates a user activated water park amusement device in accordance with a third aspect of the invention.

FIG. 5 shows a further embodiment of the invention wherein like reference numerals are used to identify like components. In FIG. 5, the tube 12 is provided with an uppermost laminar flow nozzle 26 and a single lateral spray nozzle 50. The nozzles 26,50 are provided in fluid communication with the water supply line 32 by means of an associated conduit tube 34*a*,34*b*, respectively, and user actuated valve 52. The valve 52 permits a user to independently activate water flow along either or both of the conduit tubes 34*a*,34*b* to selectively emit water from the nozzle 26 or nozzle 50, depending upon how the tube 12 is to be vibrated.

To minimize vandalism and the potential for harm, most preferably, the sidewall 18 is provided with a smooth outer surface which would discourage climbing. Optionally, the base 16 could be provided with a quick connect coupler which permits the tube 12 to be rapidly erected or disassembled from a vertical orientation.

Although the preferred embodiment of the invention discloses the use of a conduit tube 34 as providing fluid communication to the nozzles 26, the invention is not so limited. If desired, water could be provided in direct fluid communication with the hollow bore 24. Similarly, while the positioning of the conduit tube 34 along the bore 24 provides a more aesthetically pleasing appearance, in a less preferred embodiment, the conduit or conduits 34 could be secured to the outer periphery of the sidewall 18.

While the preferred embodiment illustrates the tube 12 as having a tapering cylindrical construction, the invention is not so limited. If desired, the tube could be formed with a triangular, rectangular or other geometric or irregular profile, either with or without an axially extending bore 24.

Although the disclosure describes and illustrates various preferred embodiments, the invention is not so limited. Many modifications and variations will now occur to a person skilled in the art. For a definition of the invention, reference may be had to the appended claims.

I claim:

1. A user actuated water park amusement device comprising, an elongated tubular member defining an axially extending bore and having an inlet end, an outlet end, and a water nozzle being spaced proximate said outlet end, a base for securing said tubular member in a generally upright orientation with said outlet end spaced vertically above said inlet end, a water supply conduit for providing water flow vertically along said bore and outwardly from said nozzle, said tube being characterized by a generally rigid lower portion and a semi rigid upper portion, the upper portion having a rigidity selected whereby in a relaxed state the tubular member maintaining said generally upright orientation aligned with said axis, and wherein the application of rotational or vibrational forces on said tube by the user produces deflection of the upper portion of the tubular member relative to the axis, without significant deflection of the lower end.

2. A device as claimed in claim 1 wherein said upper portion of the tube has a rigidity selected to limit the deflection of the outlet end to less than about 90°.

3. A device as claimed in claim 1 wherein said nozzle is a laminar water flow nozzle provided in an uppermost end of said tubular member.

4. A device as claimed in claim 1 further including a flexible conduit tube extending from the inlet end to the outlet end, the conduit tube providing fluid communication between the water supply conduit and the nozzle.

5. A device as claimed in claim 1 wherein said tubular member comprises fiberglass.

6. A device as claimed in claim 5 wherein said tubular member has a length selected at between about six feet and thirty feet.

7. A device as claimed in claim 1 wherein said nozzle is positioned at least about eight feet above said base.

8. A device as claimed in claim 1 further including a user actuated valve, wherein the activation of said valve initiates water flow from said outlet nozzle.

9. A user actuated water amusement device comprising, an elongated hollow tubular member having a radially extending sidewall defining a hollow axially extending bore, in an unbiased position the tube extending generally vertically along said axis from a lower inlet end to an upper outlet end, a water supply conduit for providing water flow vertically along said bore and outwardly from said outlet end, said sidewall including a lower portion having a first minimum radial thickness and an upper portion having a second radial thickness selected less than the first thickness, the first and second thicknesses selected to permit deflection of the upper outlet end to a biased position moved away from the axis upon the application of a manual rotational or vibrational force by said user, without significant deflection of the lower portion.

10. The device as claimed in claim 9 further including a base for securing said tubular member in said generally vertical orientation.

11. The device as claimed in claim 10 wherein said second radial thickness is selected to limit deflection of the outlet end to less than about 60° from said axis.

12. The device as claimed in claim 9 further including laminar water flow nozzle positioned at said outlet end.

13. The device as claimed in claim 12 further including a conduit tube extending from the inlet end to the outlet end, the conduit tube providing fluid communication between the supply conduit and the nozzle.

14. The device as claimed in claim 9 wherein said sidewall comprises wound filament strands selected from fiberglass and plastic.

15. The device as claimed in claim 9 wherein said tubular member has a length selected at between about six feet and thirty feet.

16. The device as claimed in claim 9 wherein said tubular member has a length of at least about twelve feet and said sidewall tapers along substantially its entire length.

17. The device as claimed in claim 9 further including a user actuated valve, wherein the selective activation of said valve by said user initiates water flow from said outlet end.

18. The device as claimed in claim 9 wherein said lower portion has a length of at least about five feet.

19. The device as claimed in claim 9 wherein said tubular member has a maximum diameter adjacent the inlet end of between about two and six inches, and a minimum diameter adjacent the outlet end of between about 0.5 and four inches.

20. A user actuated water amusement device comprising, a tubular member elongated along a longitudinally extending axis, and defining an axially extending bore, said tubular member having a lower inlet end, an outlet end, and a water nozzle being spaced proximate said outlet end said tubular member secured in a generally vertical orientation with said outlet end spaced vertically above said inlet end, a water supply conduit for providing water flow vertically along said member and outwardly from said nozzle, said tube being characterized by a generally rigid lower portion having a length selected greater than a height of said user and a semi rigid upper portion spaced above said lower portion, the upper portion having a rigidity selected whereby the application of lateral, rotational or vibrational forces on said tube produce a maximum downward deflection of the outlet end to a position spaced vertically above the lower portion.

* * * * *